US008651676B2

(12) United States Patent
Nottage

(10) Patent No.: US 8,651,676 B2
(45) Date of Patent: Feb. 18, 2014

(54) FOLDABLE COMPACT MIRROR APPARATUS

(75) Inventor: Kenia Nottage, Wakefield (GB)

(73) Assignee: Prospect Ridge Limited, Nassau (BS)

( * ) Notice: Subject to any disclaimer, the term of this patent is extended or adjusted under 35 U.S.C. 154(b) by 196 days.

(21) Appl. No.: 13/000,362

(22) PCT Filed: Jun. 23, 2009

(86) PCT No.: PCT/GB2009/001560

§ 371 (c)(1),
(2), (4) Date: Dec. 21, 2010

(87) PCT Pub. No.: WO2009/156716

PCT Pub. Date: Dec. 30, 2009

(65) Prior Publication Data

US 2011/0102922 A1 May 5, 2011

(30) Foreign Application Priority Data

Jun. 24, 2008 (GB) ..... 0811556.0

(51) Int. Cl.
*G02B 5/08* (2006.01)
*G02B 7/182* (2006.01)

(52) U.S. Cl.
USPC ..... 359/855; 359/865; 359/871

(58) Field of Classification Search
USPC ..... 359/855
See application file for complete search history.

(56) References Cited

U.S. PATENT DOCUMENTS

| | | | | |
|---|---|---|---|---|
| 2,124,146 | A | 7/1938 | Miller | |
| 2,981,256 | A * | 4/1961 | Besnah | 607/95 |
| 4,146,308 | A | 3/1979 | Cohen | |
| D552,851 | S * | 10/2007 | Abrahamian et al. | D6/301 |
| 7,347,573 | B1 | 3/2008 | Isler | |
| 2004/0008434 | A1 | 1/2004 | Yang | |

FOREIGN PATENT DOCUMENTS

| | | |
|---|---|---|
| JP | 2004350729 A | 5/2003 |
| JP | 2005287540 A | 3/2004 |

OTHER PUBLICATIONS

International Search Report for PCT/GB2009/001560 from the European Patent Office completed on Dec. 11, 2009 and mailed Dec. 21, 2009 (4 pages).
Search Report for GB 0811556.0 from the UK Intellectual Property Office; Date of search : Oct. 11, 2008 (2 pages).

* cited by examiner

*Primary Examiner* — Jade R Chwasz
(74) *Attorney, Agent, or Firm* — Pyprus Pte Ltd

(57) ABSTRACT

Foldable compact mirror apparatus (10) comprises at least three planar mirror elements (12) which are foldably interconnected so that the planes of the mirror elements (12) can lie in parallel or substantially in parallel with each other, and attachment means (16) for releasably attaching the mirror elements (12) to an upright surface. Preferably, the mirror elements (12) have different widths to provide a tapering appearance and reduced weight during transport.

16 Claims, 2 Drawing Sheets

FIG. 3
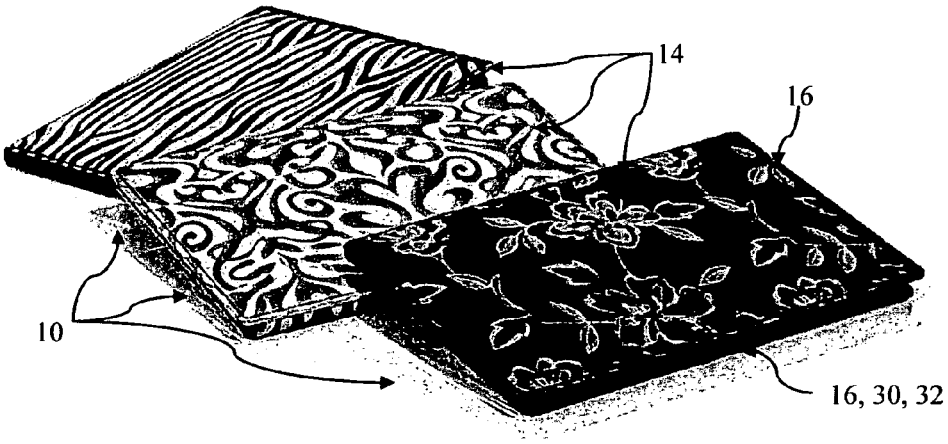
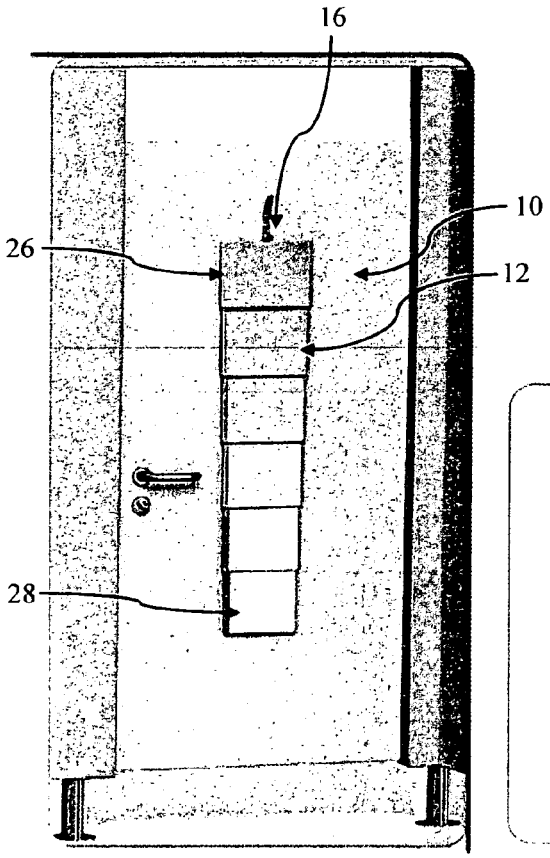
FIG. 4
FIG. 5
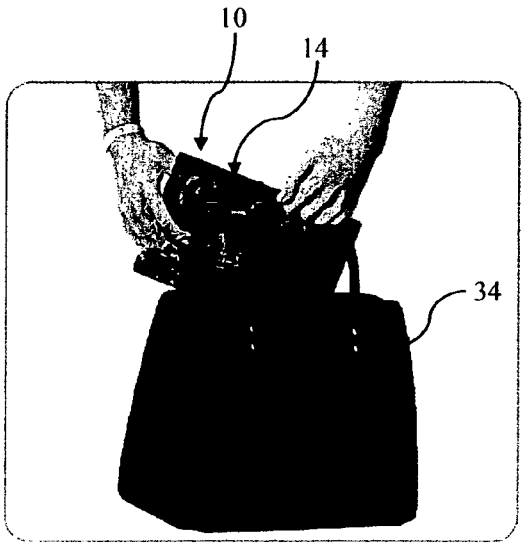

FOLDABLE COMPACT MIRROR APPARATUS

The present invention relates to mirror apparatus which is both foldable and compact.

Compact mirrors are known, but these are typically tiny make-up mirrors provided in a clam-shell housing which also stores a small amount of cosmetics materials, such as foundation and eye-shadow. There is a requirement for an easily portable, full-height or three-quarter length mirror that a person can carry and use, for example, in a toilet or restroom in order to check their overall appearance and dress.

The present invention seeks to provide such a solution.

According to the present invention, there is provided foldable compact mirror apparatus comprising at least three planar mirror elements which are foldably interconnected so that the planes of the mirror elements can lie in parallel or substantially in parallel with each other, and attachment means for releasably attaching the mirror elements to an upright surface.

Preferable and/or optional features of the invention are set forth in claims 2 to 13, inclusive.

The present invention will now be more particularly described, by way of example only, with reference to the accompanying drawings, in which:

FIG. 3 shows a plurality of the mirror apparatus in folded conditions and with different exterior appearances;

FIG. 4 shows the mirror apparatus in use; and

FIG. 5 shows dimensions of the folded mirror apparatus in relation to a typical handbag.

Figure 1:
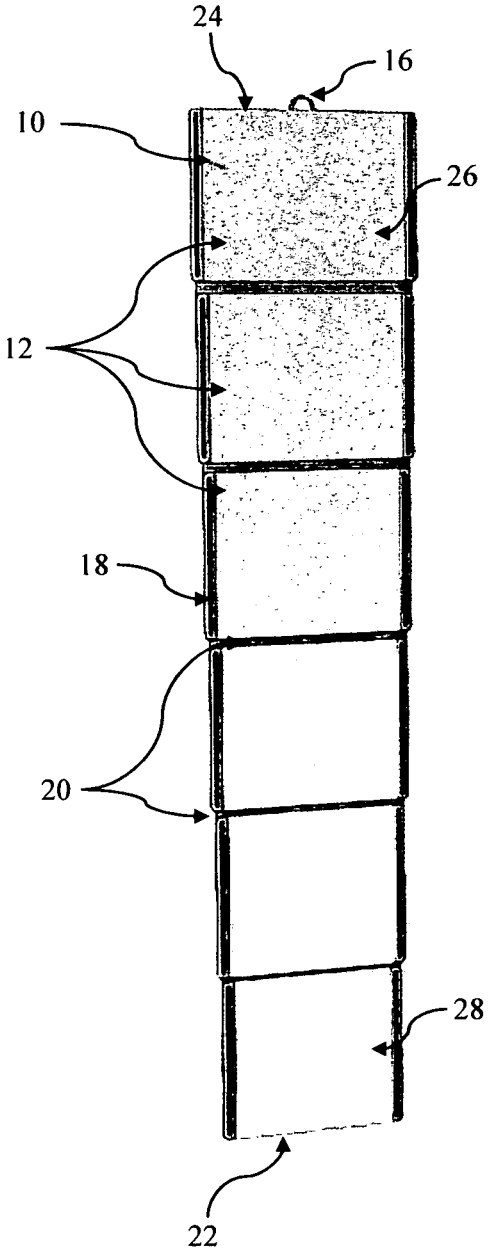
FIG. 1 is a perspective view from the front of one embodiment of foldable compact mirror apparatus, shown unfolded and in accordance with the invention.
Figure 2:
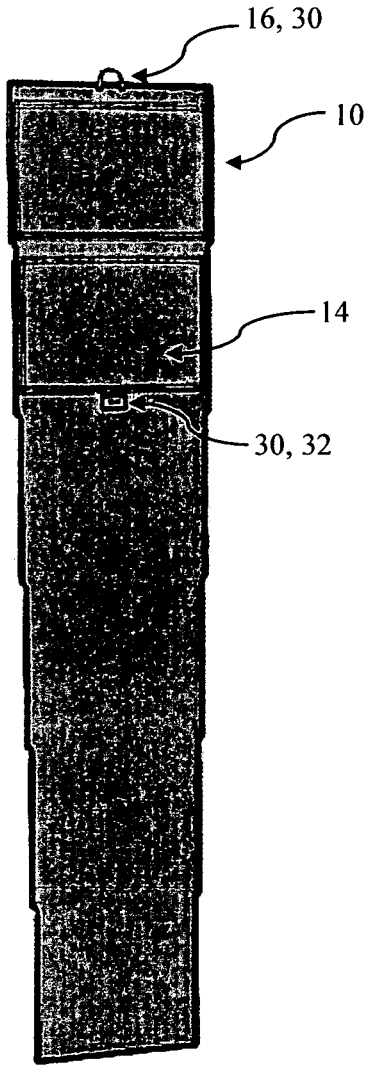
FIG. 2 is a perspective view from the rear of the mirror apparatus shown in FIG. 1.

Referring to the drawings, there is shown mirror apparatus 10 which comprises a plurality of mirror elements 12 mounted on a backing support element 14, and attachment means 16 in the form of a loop on an upper lateral edge of the support element 14.

Each mirror element 12 is formed of thin planar material, such as transparent acrylic or other transparent plastics with an aluminium or other reflective coating across a rear major surface. The use of acrylic or other plastics enables the mirror element 12 to be extremely thin, lightweight and robust. Each mirror element 12 is typically no more than 1 mm in thickness.

In this embodiment, six mirror elements 12 are provided. However, more or less than six mirror elements can be provided. To enable a sufficient length of mirror to be provided, however, at least three mirror elements are essential.

The mirror elements 12 are held in spaced interconnected relationship via the backing support element 14. The support element 14 may be flexible fabric or plastics, and may be patterned in whole or in part to provide an aesthetically appealing appearance, as shown in FIG. 3. The support element 14, in this embodiment, is one-piece, and as such the mirror elements 12 are mounted thereon by bonding and/or stitching so that the support element 14 extends fully across a rear surface of each mirror element 12. The support element 14 preferably extends slightly beyond a perimeter edge 18 of each mirror element 12, to provide protection against damage. As such, each mirror element 12 may be slightly recessed or encased in the support element 14.

The mirror elements 12 are spaced sufficiently from each other to allow folding of the mirror elements 12 onto each other. As such, the spacing 20 between the adjacent mirror elements 12 may increase from one edge, in this case the lower edge 22, to the other edge 24 to compensate for the increasing thickness as the mirror elements 12 are folded together in a generally rolling configuration.

The support element 14 is elongate, and as such the mirror elements 12 are arranged thereon in a straight or rectilinear substantially edge-to-edge line.

A width of each mirror element 12 is preferably less than that of an adjacent mirror element 12, so that the apparatus 10 has a tapered or substantially tapered appearance from the uppermost edge 24 to a lowermost edge 22. As such, the uppermost mirror element 26 has the greatest width, and the lowermost mirror element 28 has the least width. Mirror elements may be provided which have the same width as adjacent mirror elements, but overall the apparatus 10 generally tapers from top to bottom. Each of the said at least three essential mirror elements mentioned above has a width which is less than that of the other said essential mirror elements to provide a tapering appearance when unfolded. Preferably, the essential mirror elements are neighbouring and consecutive, but other arrangements are feasible with different sized or same size mirror elements interposed.

Fastening means 30 is also provided for holding the mirror elements 12 in a closed or folded condition. The mirror elements 12 are planar, and thus once folded onto each other, the planes of the mirror elements 12 lie in or substantially in parallel. By folding the rigid mirror elements 12 in a substantially rolling fashion, the mirror apparatus 10 presents the backing support element 14 as an exterior aesthetically-pleasing surface. Conveniently, the attachment means 16 can be utilised as part of the fastening means 30. In this embodiment, the loop 16 of the attachment means is also utilised along with a stylish hook 32 provided on the support element 14 at or adjacent to an edge of an adjacent mirror element 12. As such, once in a folded condition, the loop 16 can be releasably engaged with the hook 32 to retain the mirror apparatus 10 in a safely closed position.

Other fastening means can of course be envisaged. For example, a hook and loop fastening device, such as Velcro RTM, can be used, a magnetic fastener, and/or press-stud fasteners. In the case of a magnetic fastener, for example, the widest and third widest mirror elements may include lightly magnetised oppositely-polarised metallised mirror backing surfaces so that, when folded, the two abutting surfaces magnetically attract each other, retaining the apparatus in its folded condition.

Alternatively or additionally, other attachment means for releasably attaching the mirror elements via the backing support element to an upright or vertical surface can also be considered. For example, one or more suction cups, and/or magnetic device for attachment to metal surfaces are feasible.

The mirror elements 12 have a depth which, when the apparatus 10 is suspended in its unfolded or unfurled condition, provides a three-quarter or fill-length substantially full mirrored surface. See FIG. 4. The depths or lengths of the mirror elements 12 are substantially equal, but may decrease slightly from the narrowest mirror element 28 to the widest mirror element 26 in order to accommodate folding.

The dimensions of the mirror apparatus 10, when folded, are suitably small to enable carrying in a ladies handbag 34, a shoulder bag and/or a standard briefcase. See FIG. 5. Example, dimensions are, for width, in the range of 15 centimeters cm to 40 cm, and more preferably 25 cm, and for length, when folded, in the range of 10 cm to 30 cm, and more preferably 20 cm.

Although the backing support element is one-piece, it may comprise one or more strips, straps or runners which extend over the rear surface of the mirror elements for interconnection. Furthermore, the support element may be single element or a plurality of element.

The mirror elements described above are preferably resilient plastics, which make them difficult to break or shatter. However, it is entirely feasible that glass or any other suitable transparent or reflective material could be used.

The mirror apparatus described folds by turning one mirror element to lie on or adjacent to another mirror element in a rolling or unidirectional motion. However, the mirror elements can be folded in a zigzag or concertinaed manner.

It is thus possible to provide portable foldable compact mirror apparatus which provides a three-quarter or full-length mirrored surface and which can be stored in a personal portable container, bag or hand bag. The mirror apparatus can be suspended or temporarily affixed to almost any upright or vertical surface so that the mirror elements hang one below the other from an uppermost mirror element to a lowermost mirror element, allowing a user to view and adjust their entire outfit. The tapering mirror elements reduce weight whilst still allowing a user to view their entire or substantially entire form.

The embodiments described above are provided by way of examples only, and various other modifications will be apparent to persons skilled in the art without departing from the scope of the appended claims.

The invention claimed is:

1. Foldable compact mirror apparatus for carrying in a lady's handbag and for hanging in a changing cubicle, the apparatus comprising at least three planar mirror elements which are foldably interconnected so that the planes of the mirror elements can lie in parallel or substantially in parallel with each other, and attachment means for releasably attaching the mirror elements to an upright surface, wherein, when the apparatus is fully unfurled to adopt a planar condition so that the foldably interconnected at least three planar mirror elements are coplanar, widths of adjacent said mirror elements increase from one end of the apparatus to the other so that symmetrical tapering occurs about a longitudinal centerline thereby providing a tapering appearance along both longitudinal edges of the foldable compact mirror apparatus.

2. Foldable compact mirror apparatus as claimed in claim 1, wherein the attachment means is temporarily engagable with a supporting surface.

3. Foldable compact mirror apparatus as claimed in claim 1, wherein the attachment means can hold the mirror elements in a hanging arrangement one below the other from an upper most mirror element to a lower most mirror element.

4. Foldable compact mirror apparatus as claimed in claim 1, wherein the said at least three planar mirror elements are hingably interconnected.

5. Foldable compact mirror apparatus as claimed in claim 1, wherein each mirror element is spaced from an adjacent mirror element.

6. Foldable compact mirror apparatus as claimed in claim 1, further comprising a support element which interconnects the mirror elements.

7. Foldable compact mirror apparatus as claimed in claim 6, wherein the support element extends across a rear of each mirror element.

8. Foldable compact mirror apparatus as claimed in claim 1, further comprising fastening means for fastening the mirror elements together in a folded condition.

9. Foldable compact mirror apparatus as claimed in claim 8, wherein the fastening means forms part of the attachment means.

10. Foldable compact mirror apparatus as claimed in claim 8, wherein the fastening means includes a widest and third widest mirror elements having magnetised oppositely-polarized metallised mirror backing surfaces, so that, when folded, the opposing surfaces magnetically attract each other, thereby retaining the apparatus in its folded condition.

11. Foldable compact mirror apparatus as claimed in claim 1, wherein at least five said mirror element are provided, each of the five mirror elements having a different width.

12. Foldable compact mirror apparatus as claimed in claim 11, wherein six said mirror elements are provided, each having a different width.

13. Foldable compact mirror apparatus as claimed in claim 1, wherein the mirror elements are arranged in a straight-line substantially edge-to-edge manner.

14. Foldable compact mirror apparatus as claimed in claim 1, wherein the mirror elements, when unfolded, provide a or substantially a lull height or three-quarter height flective surface for a user.

15. Foldable compact mirror apparatus as claimed in claim 1, wherein, when folded, the apparatus is storable in a user's handbag, shoulder bag, and/or briefcase.

16. Foldable compact mirror apparatus as claimed in claim 1, wherein the attachment means includes a loop, a hook and/or a suction cup.

* * * * *